US006105196A

United States Patent [19]

Chang

[11] Patent Number: 6,105,196

[45] Date of Patent: Aug. 22, 2000

[54] PUMPKIN-SHAPED BATH SCRUBBER

[76] Inventor: Che-Yuan Chang, No. 1, Lane 147, Sec. 2, Chung San Rd., Yun Lin, Chang Hua Hsien, Taiwan

[21] Appl. No.: 09/309,295

[22] Filed: May 11, 1999

[51] Int. Cl.[7] ..... A47K 7/02

[52] U.S. Cl. ..... 15/209.1; 15/229.11; D28/63; D32/40; D32/43

[58] Field of Search ..... 15/118, 208, 209.1, 15/223, 229.11; 601/137, 138; D4/137; D28/63; D32/35, 40, 43

[56] References Cited

U.S. PATENT DOCUMENTS

| | | | |
|---|---|---|---|
| 5,465,452 | 11/1995 | Girardot et al. | 15/209.1 X |
| 5,727,277 | 3/1998 | Chien | 15/209.1 |
| 5,727,278 | 3/1998 | Per-Lee | 15/229.11 |
| 5,758,386 | 6/1998 | Chen | 15/229.11 |
| 5,784,747 | 7/1998 | Girardot et al. | 15/229.11 |
| 5,947,564 | 9/1999 | Chen | 15/209.1 X |
| 5,983,435 | 11/1999 | Osborne | 15/209.1 |
| 6,038,727 | 3/2000 | Chen | 15/229.11 |

*Primary Examiner*—Mark Spisich
*Attorney, Agent, or Firm*—Browdy and Neimark

[57] ABSTRACT

A pumpkin-shaped bath scrubber comprises an elastic tubular net, two lashing members, and a ring. The elastic tubular net has a periphery which is continuously folded along the direction of the longitudinal axis of the tubular net such that the tubular net is transformed into a round cylindrical object having a wavy periphery. The two lashing members are fastened with two radial ends of the tubular net. The ring is located between one radial end of the tubular net and the lashing members. The tubular net has an unlashed portion which expands to form an expansion portion similar in form to a pumpkin. The ring is attached to one end of the expansion portion.

3 Claims, 2 Drawing Sheets

PUMPKIN-SHAPED BATH SCRUBBER

FIELD OF THE INVENTION

The present invention relates generally to a bath scrubber, and more particularly to a bath scrubber having a pumpkin shape.

BACKGROUND OF THE INVENTION

The conventional spherical bath scrubber is generally formed of a plurality of elastic tubular nets, which are braced and stretched by two support rods. The two support rods are kept apart from each other by a distance greater than the inner diameter of the tubular net. The tubular net is compressed along the direction of the longitudinal axis of the tubular net such that the tubular net is transformed into a short cylindrical object. A lashing member is fastened with the center of the tubular net. The tubular net is then removed from the two support rods, thereby resulting in the inflation of the tubular net from the place where the lashing member is fastened, so as to form a spherical bath scrubber.

Such a spherical bath scrubber of the prior art as described above is defective in design in that it is devoid of a means by which the spherical bath scrubber is held securely in the hand of a person. It is conceivably annoying to unable to hold securely the bath scrubber in the hand when one is taking a bath. In addition, the spherical bath scrubber has a very limited appeal to the consumer at large.

SUMMARY OF THE INVENTION

It is therefore the primary objective of the present invention to provide a pumpkin-shaped bath scrubber to enhance the marketability of the bath scrubber.

It is another objective of the present invention to provide a bath scrubber with a ring to facilitate the holding of the bath scrubber securely in the hand of a person in the midst of taking a bath.

In keeping with the principle of the present invention, the foregoing objectives of the present invention are attained by a pumpkin-shaped bath scrubber formed of an elastic tubular net, two lashing members fastened with both ends of the tubular net, and a ring fastened with the periphery of the tubular net by the lashing members. The tubular net is continuously folded along the direction of the longitudinal axis of the tubular net, so as to transform the tubular net into a short cylindrical object having a round expandable portion. The ring is located at one end of the expandable portion.

DETAILED DESCRIPTION OF THE INVENTION

Figure 1:
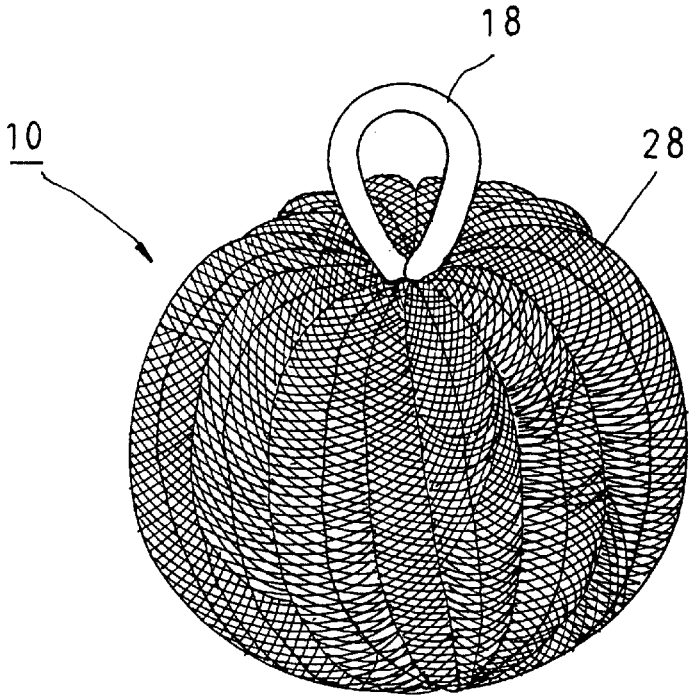
FIG. 1 shows a perspective view of a first preferred embodiment of the present invention.
Figure 2:
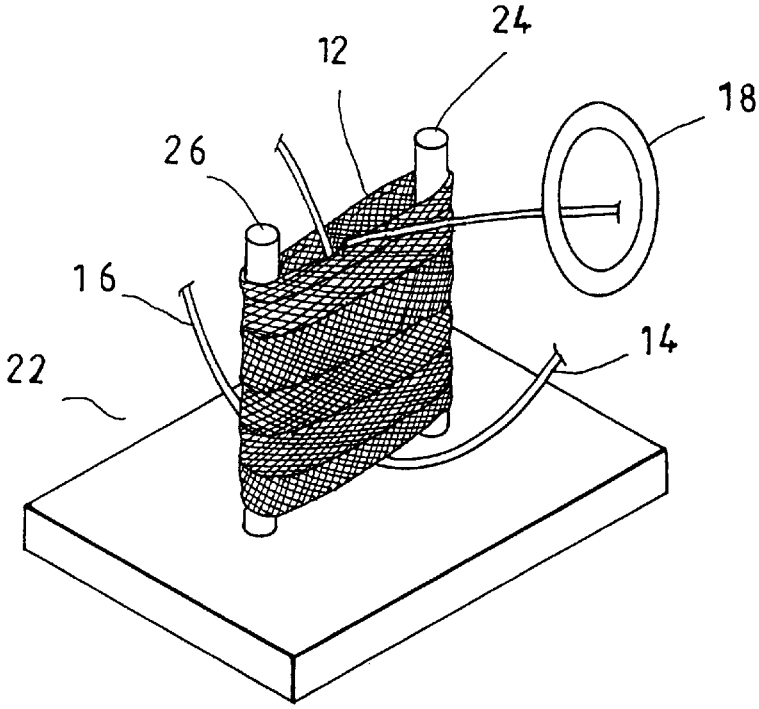
FIG. 2 shows a schematic view of forming the first preferred embodiment of the present invention.

As shown in FIGS. 1 and 2, a bath scrubber 10 of the first preferred embodiment of the present invention comprises a tubular net 12 made of an elastic material, two lashing members 14 and 16, and a ring 18.

The tubular net 12 is braced and stretched by two support rods 24 and 26 of a molding tool 22, as shown in FIG. 2. The periphery of the tubular net 12 is pushed along the direction of the axes of the support rods 24 and 26 to take a wavy shape. The tubular net 12 is thus transformed into a short cylindrical object. The lashing members 14 and 16 circumvent the inner and the outer edges of walls of two radial ends of the tubular net 12. The ring 18 is fastened with the periphery of the tubular net 12 by the lashing member 14.

The tubular net 12 is then removed from the two support rods 24 and 26. The unlashed portion of the tubular net 12 expands to form a round expansion portion 28 to which the ring 18 is attached. The ring 18 serves as a means to facilitate the holding of the bath scrubber securely in the hand of a person taking a bath. The ring 18 can be easily held with one finger while the expansion portion 28 is held in palm of the hand. The expansion portion 28 is similar in form to a pumpkin.

Figure 3:
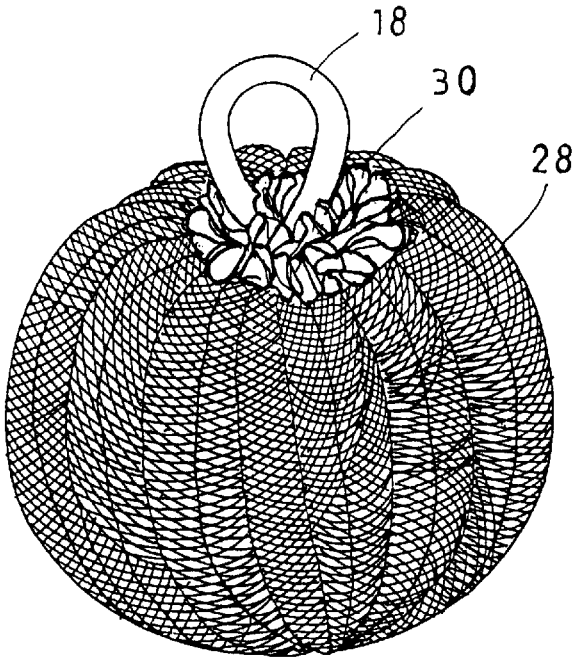
FIG. 3 shows a perspective view of a second preferred embodiment of the present invention.

As shown in FIG. 3, the bath scrubber 10 of the present invention is further provided with a ribbon 30, which is lashed along with the ring 18 by the first lashing member 14 and is so arranged as to imitate the stalk end of a pumpkin.

Figure 4:
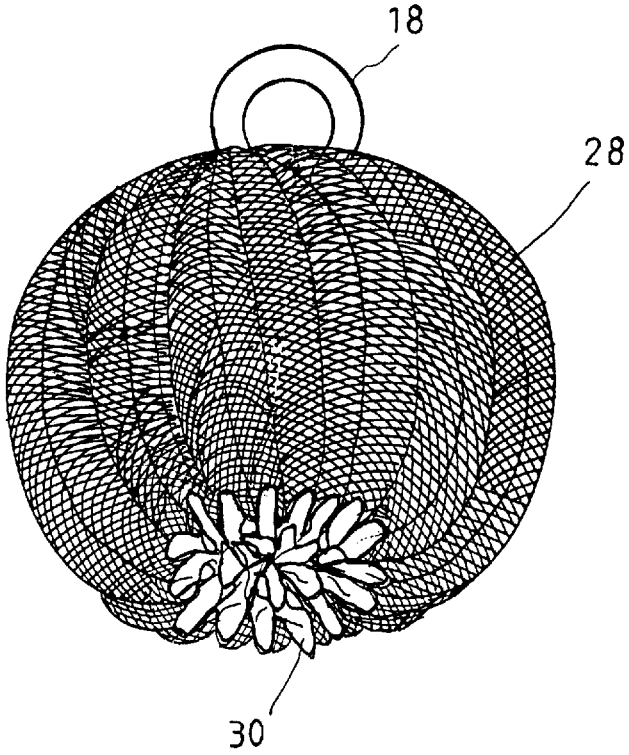
FIG. 4 shows a perspective view of a third preferred embodiment of the present invention.

As shown in FIG. 4, the ribbon 30 is fastened with the expansion portion 28 such that the ribbon 30 is lashed at the position where the tubular net 12 is lashed by the second lashing member 16, and that the ribbon 30 is opposite in location to the ring 18.

What is claimed is:

1. A pumpkin-shaped bath scrubber comprising:

an elastic tubular net having a periphery which is continuously folded along the direction of a longitudinal axis of said tubular net such that said tubular net is transformed into a round cylindrical object having a wavy periphery;

two lashing members fastened with two radial ends of said tubular net; and a ring located between one radial end of said tubular net and said two lashing members;

said tubular net having an unlashed portion which expands to form an expansion portion similar in shape to a pumpkin, with said ring being attached to one end of said expansion portion.

2. The bath scrubber as defined in claim 1 further comprising a ribbon which is lashed at a position where said ring is fastened with said tubular net.

3. The bath scrubber as defined in claim 1 further comprising a ribbon which is lashed between other radial end of said tubular net and said lashing members and is opposite in location to said ring.

* * * * *